US006665949B1

(12) United States Patent
Reis et al.

(10) Patent No.: US 6,665,949 B1
(45) Date of Patent: Dec. 23, 2003

(54) DRYING TOOL FOR HONEYCOMB CORE

(75) Inventors: Carl A. Reis, Torrance, CA (US); Doris Andren Reis, Torrance, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 138 days.

(21) Appl. No.: 09/911,990

(22) Filed: Jul. 24, 2001

(51) Int. Cl.[7] ..... F26B 19/00

(52) U.S. Cl. ..... 34/232; 34/90; 34/104; 34/229; 34/241

(58) Field of Search ..... 34/96, 97, 98, 34/99, 232, 229, 234, 90, 241, 60, 104

(56) References Cited

U.S. PATENT DOCUMENTS 3,726,021 A * 4/1973 Waters et al. ..... 34/99
4,091,546 A * 5/1978 Bochan ..... 34/73
4,118,874 A * 10/1978 Morane ..... 34/101
5,067,444 A * 11/1991 Parker ..... 119/606
5,275,339 A * 1/1994 Andis et al. ..... 239/443
5,526,578 A * 6/1996 Iyer ..... 34/97
5,956,863 A * 9/1999 Allen ..... 34/97

* cited by examiner

*Primary Examiner*—Ira S. Lazarus
*Assistant Examiner*—Kathryn S. O'Malley
(74) *Attorney, Agent, or Firm*—Stetina Brunda Garred & Brucker

(57) ABSTRACT

A drying tool for drying moisture present in cells of a honeycomb core. The tool includes an inflatable bladder compartment having a bendable exterior surface and a plurality of open-ended nozzles protruding from this exterior surface, with each nozzle having a passage in fluid communication with the bladder compartment. A connector element is connectible with a hot air source for delivering hot air into the bladder compartment for subsequent dispatch through the plurality of nozzles. Preferably, the nozzles are situated in a grid formation and are of a generally conical configuration. In use, the bendable exterior surface with the protruding nozzles is bowed or curved to generally configure to the exterior shape of the honeycomb core such that hot air is pinpointed in a grid pattern to drive heated air into the core and thereby cause circulation through the core cells for moisture evaporation.

15 Claims, 1 Drawing Sheet

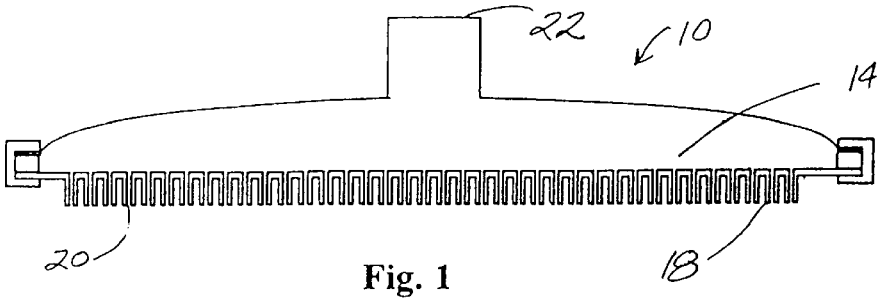
Fig. 1
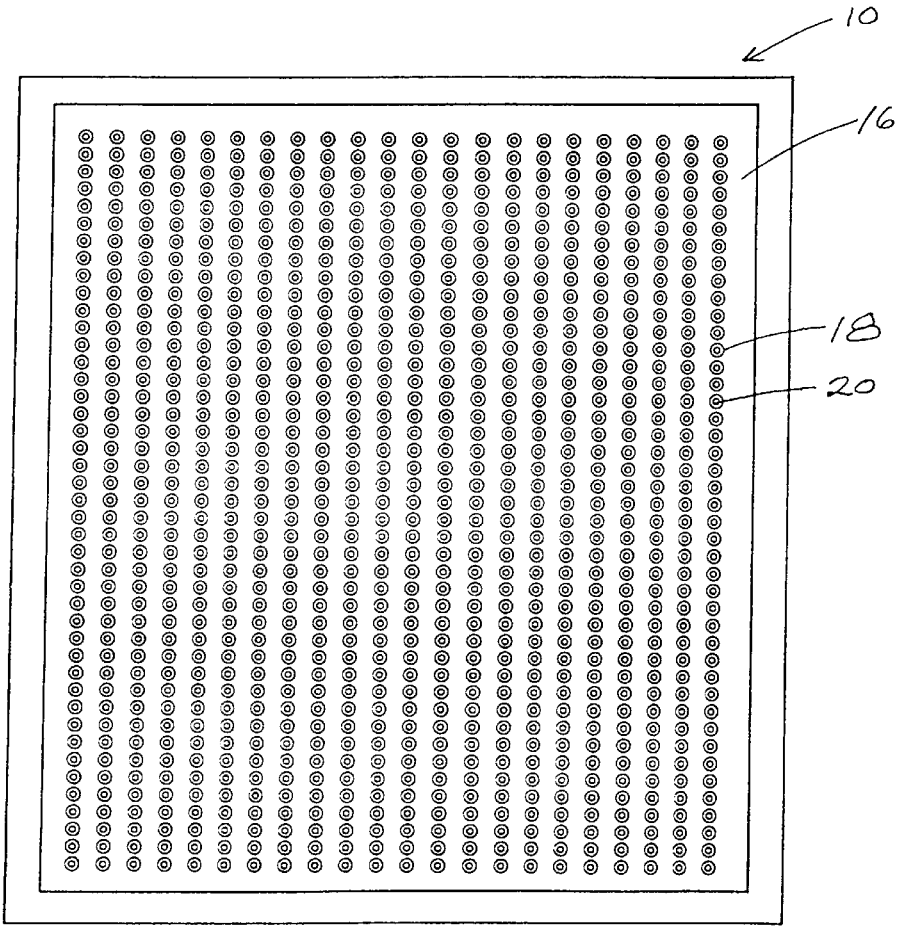
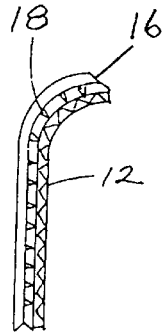
Fig. 3
Fig. 2

DRYING TOOL FOR HONEYCOMB CORE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates in general to drying tools for drying moisture present within cells of honeycomb cores, and in particular to a drying tool with an inflatable bladder compartment from which a plurality of open-ended nozzles protrude and through which upstream hot air supplied to the bladder compartment is pinpointedly directed against the honeycomb core at a plurality of sites for forcing a circulation of hot air among the cells to thereby remove moisture content.

Honeycomb cores are commonly employed in the construction of many structures that require relatively light weight coupled with relatively strong integrity. Chief among examples of such structural requirements is that of components of an aircraft. In particular, floor panels, engine nacelles, flaps, leading edge components, overhead bins, galley cabinetry, and the like all can be fabricated using a honeycomb core sandwiched between adhesively attached external skin material such that an integrated strong construction is achieved while overall aircraft weight objectives are maintained. One such honeycomb core product that is widely utilized is fabricated from NOMEX aramid paper (NOMEX is a registered trademark of the DuPont Company, Wilmington, Del.), and exhibits flame and chemical resistence as well as good thermal insulation.

While initial fabrication of such honeycomb core products is relatively straightforward, the repair of a damaged product whose skin, typically a composite material, requires replacement, can be a difficult task. Specifically, two major factors contribute toward skin replacement success. First, because the replaced composite skin is applied before being cured and therefore is cured in place, a curing temperature at least above 200° F. must be applied to cure the composite material, and this temperature also heats the adjoining honeycomb core. Second, because of ambient exposure of the honeycomb core water moisture enters the honeycomb cells, and this trapped moisture can expand up to 1,200 times normal when the core is heated above the boiling point of water. When this expansion occurs, the cellular structure of the honeycomb core is damaged and disbanding of the replacement skin occurs.

As is thus apparent, proper repair of such a structure with a honeycomb core is greatly enhanced in relation to successful drying of the core structure. At present, such moisture removal is typically attempted by using heat blankets and/or blown hot air on top of the core to theoretically cause wicking of moisture upwardly within the core and thereby promote core drying. Unfortunately, however, this existing approach is generally inefficient since pockets of air inherently present in the core cells themselves resist circulation of applied heat and thus resist moisture wicking and drying. Consequently, a need is present for a drying tool capable of eliminating moisture present in honeycomb core cells and thus promote proper repair results for exterior skin patching.

In accord therewith, a primary object of the present invention is to provide a drying tool capable of delivering hot air to moisture sites within a honeycomb core.

Another object of the present invention is to provide a drying tool constructed to simultaneously direct a multitude of hot-air streams precisely in line with core cells for forcing heat circulation and moisture desiccation.

Still another object of the present invention is to provide a drying tool whose directed hot-air streams are flexibly positional against a honeycomb core for intimate-interface contact with the shaped surface of the core.

These and other objects of the present invention will become apparent throughout the description thereof which now follows.

BRIEF SUMMARY OF THE INVENTION.

The present invention is a drying tool for drying moisture present in cells of a honeycomb core. The tool includes an inflatable bladder compartment having a bendable generally flat exterior surface and a plurality of open-ended nozzles protruding from this exterior surface, with each nozzle having a passage there through in fluid communication with the bladder compartment. Finally, a connector element is provided to be in fluid communication with the bladder compartment and connectible with a hot air source for delivering hot air into the bladder compartment for subsequent dispatch therefrom through the plurality of nozzles. Preferably, the nozzles are situated in a grid formation and are of a generally conical configuration. In use, the bendable exterior surface with the protruding nozzles is bowed or curved to generally configure to the exterior shape of the honeycomb core such that hot air is pinpointed in a grid pattern to drive heated air into the core and thereby cause circulation through the core cells for moisture evaporation. In this manner, a non-curedcomposite repair patch can be applied and adhered over and to the exposed honeycomb core portion and thereafter cured in place at a required cure temperature without fear of core damage due to moisture expansion and resulting disbanding of the patch.

BRIEF DESCRIPTION OF THE DRAWINGS

An illustrative and presently preferred embodiment of the invention is shown in the accompanying drawings in which:

FIG. 1 is a side elevation view of a drying tool for drying moisture present in cells of a honeycomb core;

FIG. 2 is a bottom plan view of the drying tool of FIG. 1; and

FIG. 3 is a side elevation view of a portion of the drying tool of FIG. 1 in association with a portion of a honeycomb core.

DETAILED DESCRIPTION OF THE INVENTION

Referring first to FIGS. 1 and 2, a drying tool 10 is shown for use in drying moisture present in cells of a honeycomb core 12 (FIG. 3). The tool 10 preferably is fabricated of a flexible material such as silicone rubber to create a bladder compartment 14 having a bendable generally flat exterior surface 16 from which a plurality of open-ended nozzles 18 protrude and are situated in a grid formation such that each nozzle 18 is between about 0.10 and 0.50 inch, most preferably about 0.25 inch, from all immediately next-adjacent nozzles 18. Each nozzle 18 preferably is a generally conical configuration and protrudes from the generally flat exterior surface 16 preferably between about 0.25 inch and about 0.75 inch, most preferably about 0.50 inch. A preferably generally-cylindrical passage 20 of a preferable diameter between about 0.01 inch and about 0.10 inch, most preferably 0.05 inch, is provided to each nozzle 18 to be in fluid communication with the bladder compartment 14. Finally, a connector element such as a threaded opening 22 is in communication with the bladder compartment 14. and connectible with a hot air source such as a complementarily threaded delivery tube (not shown) for delivering hot air into the bladder compartment 14 for subsequent hot-air dispatch therefrom through the respective passages 20 of the nozzles 18.

In operation, and as illustrated in FIG. 3, the bendable exterior surface 16 with the protruding nozzles 18 is bowed or curved to generally configure to the exterior shape of the honeycomb core 12 such that hot-air is pinpointedly discharged from each nozzle 18 in a grid pattern to drive heated air into the core 12 and thereby cause circulation through the core cells for moisture evaporation. The most preferred grid formation, where each nozzle 18 is about 0.25 inch from all immediately next-adjacent nozzles 18, is chosen to allow for variations in core types while also focusing on currently popular cell sizes. As opposed to simply providing circulating hot air over the core surface and not within the core as performed in the prior art, by providing pinpoint, and thus penetrating, hot-air discharge from each nozzle 18 aimed at the cells at the wall of the honeycomb core 12 as here taught, an entry and exit flow of circulated heated air can occur within every other cell. In this manner, deep core drying is accomplished efficiently in a relatively short period of time such that patch application and patch curing can be performed without lengthy downtime or repetition due to patch disbanding.

While an illustrative and presently preferred embodiment of the invention has been described in detail herein, it is to be understood that the inventive concepts may be otherwise variously embodied and employed and that the appended claims are intended to be construed to include such variations except insofar as limited by prior art.

What is claimed is:

1. A drying tool for drying moisture present in cells of a honeycomb core of a structure, the drying tool comprising:

a bladder compartment being inflatable to define a generally flat exterior surface, the generally flat exterior surface being bendable to conform to a configuration of the honeycomb core when inflated and applied thereon so as to allow the honeycomb core to be dried uniformly by the drying tool;

a plurality of open-ended nozzles protruding from the generally flat exterior surface, each said nozzle having a passage there through in fluid communication with the bladder compartment; and a connector element in fluid communication with the bladder compartment and connectable with a hot air source for delivering hot air into the bladder compartment for subsequent dispatch therefrom through the plurality of nozzles.

2. A drying tool as claimed in claim 1 wherein the nozzles are situated in a grid formation to dispatch hot air into the cells of the honeycomb core.

3. A drying tool as claimed in claim 2 wherein each of the plurality of nozzles is between about 0.10 and 0.50 inch from all immediately next-adjacent nozzles.

4. A drying tool as claimed in claim 3 wherein each of the plurality of nozzles is about 0.2.5 inch from all immediately next-adjacent nozzles.

5. A drying tool as claimed in claim 1 wherein each nozzle protrudes from the generally flat exterior surface between about 0.25 inch and 0.75 inch.

6. A drying tool as claimed in claim 5 wherein each said passage is of a diameter between about 0.01 inch and about 0.10 inch.

7. A drying tool as claimed in claim 1 wherein each said passage is of a diameter between about 0.01 inch and about 0.10 inch.

8. A drying tool as claimed in claim 1, wherein the passage of each nozzle is generally cylindrical.

9. A drying tool as claimed in claim 8 wherein each said passage is of a diameter between about 0.01 inch and about 0.10 inch.

10. A drying tool as claimed in claim 1 wherein each said passage is of a diameter between about 0.01 inch and about 0.10 inch.

11. A drying tool as claimed in claim 1, wherein the material for forming the drying tool includes silicone rubber.

12. A drying tool as claimed in claim 1, wherein the nozzles are operative to discharge a plurality of concentrated, substantially parallel hot air streams.

13. A drying tool for drying moisture within cells of a honeycomb core, comprising:

a bladder compartment, being inflatable to define a generally flat exterior surface;

a connector element in fluid communication with the bladder compartment and connectable to a hot air source for delivering hot air into the bladder compartment; and a plurality of nozzles protruding from the generally flat exterior surface to discharge the hot air into a plurality of hot air streams to the honeycomb core;

wherein upon inflation the flat exterior surface is bendable to conform to a configuration of the honeycomb core when applied thereon so as to allow the honeycomb core to be dried uniformly by the drying tool and to direct the hot air streams discharged from the nozzle in a desired direction.

14. A drying tool as claimed in claim 13, wherein the nozzles are operative to concentrate each of the discharged hot air streams towards the honeycomb core.

15. A drying tool as claimed in claim 13, wherein the nozzles are conical in shape.

* * * * *